US008965244B2

(12) United States Patent
Shimizu

(10) Patent No.: US 8,965,244 B2
(45) Date of Patent: Feb. 24, 2015

(54) IMAGE FORMING APPARATUS, OPTICAL PRINT HEAD, AND PROCESS CARTRIDGE WITH PLATES FOR POSITIONING IMAGE BEARING MEMBER AND DEVELOPING MEMBER

(75) Inventor: Kenichi Shimizu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 361 days.

(21) Appl. No.: 13/301,184

(22) Filed: Nov. 21, 2011

(65) Prior Publication Data

US 2012/0148292 A1 Jun. 14, 2012

(30) Foreign Application Priority Data

Dec. 10, 2010 (JP) ..... 2010-275886

(51) Int. Cl.
*G03G 15/00* (2006.01)
*G03G 15/043* (2006.01)
*G03G 15/04* (2006.01)

(52) U.S. Cl.
CPC ..... *G03G 15/0435* (2013.01); *G03G 15/04054* (2013.01)
USPC ..... 399/118; 399/107

(58) Field of Classification Search
USPC ..... 399/118, 107, 126, 177, 198, 201, 202, 399/205
See application file for complete search history.

(56) References Cited

U.S. PATENT DOCUMENTS

| | | | | |
|---|---|---|---|---|
| 6,538,679 | B2 | 3/2003 | Hiyoshi | |
| 2008/0279585 | A1 * | 11/2008 | Furuichi et al. | 399/118 |
| 2010/0238257 | A1 * | 9/2010 | Sakamoto | 347/224 |

FOREIGN PATENT DOCUMENTS

| | | | |
|---|---|---|---|
| JP | 6-8516 | | 1/1994 |
| JP | 6-64227 | | 3/1994 |
| JP | 2001-130047 | A | 5/2001 |
| JP | 2001-205844 | | 7/2001 |
| JP | 2002-137438 | | 5/2002 |
| JP | 2005-131835 | | 5/2005 |
| JP | 2005-335074 | | 12/2005 |
| JP | 2007-22060 | | 2/2007 |
| JP | 2008-143010 | A | 6/2008 |
| JP | 2009-15060 | A | 1/2009 |
| JP | 2010-32649 | A | 2/2010 |

OTHER PUBLICATIONS

English Machine Translation of JP 2005-335074 published on Dec. 8, 2005.*

Japanese Office Action issued Aug. 26, 2014 in Patent Application No. 2010-275886 (without English Translation).

* cited by examiner

*Primary Examiner* — Billy Lactaoen
(74) *Attorney, Agent, or Firm* — Oblon, Spivak, McClelland, Maier & Neustadt, L.L.P.

(57) ABSTRACT

An image forming apparatus having an image bearing member, an optical print head to irradiate the image bearing member with light to form a latent image thereon, a developing device to develop the latent image with a developing agent to obtain a visual image, and front and rear plates that sandwich at least the image bearing member and the developing device from opposite directions to position at least the image bearing member and the developing device thereof, the plates having focus direction position determining reference surfaces and sub-scanning direction position determining reference surfaces the optical print head contacts to position the optical print head.

12 Claims, 9 Drawing Sheets

IMAGE FORMING APPARATUS, OPTICAL PRINT HEAD, AND PROCESS CARTRIDGE WITH PLATES FOR POSITIONING IMAGE BEARING MEMBER AND DEVELOPING MEMBER

CROSS-REFERENCE TO RELATED APPLICATIONS

This patent application is based on and claims priority pursuant to 35 U.S.C. §119 to Japanese Patent Application No. 2010-275886, filed on Dec. 10, 2010, the entire disclosure of which is hereby incorporated by reference herein.

FIELD OF THE INVENTION

The present invention relates to an image forming apparatus, an optical print head, and a process cartridge.

BACKGROUND OF THE INVENTION

Description of the Background Art

Various photocopiers, printers, facsimile machines, and multi-function peripheral thereof that employ electrophotography are widely known image forming technologies. In the image forming process thereof, a latent electrostatic image is formed on the surface of a photoreceptor drum serving as an image bearing member; the latent electrostatic image on the photoreceptor drum is developed with a development agent such as toner to obtain a visual image; the visual image is transferred to a recording medium (also referred to as a recording material, typically paper); and the toner image on the recording medium is fixed thereon by a fixing device upon application of pressure and/or heat. In such image forming apparatuses employing electrophotography, it is known that a self-scanning-type optical print head having micro light-emitting segment arrays that selectively emit light from many light-emitting units arranged in array can be used.

The micro light-emitting segment array of the optical print head includes a light-emitting element array or liquid crystal shutter formed of an LED, etc. When the micro light-emitting segment array has a light-emitting element array, many micro light-emitting elements such as LEDs serve as light-emitting units. When the micro light-emitting segment array has a liquid crystal shutter, liquid crystal cells serve as light-emitting units. In both cases, the light-emitting units are arranged in array consisting of units of pixels.

Such light-emitting elements radiate diffused light from a predetermined point or plane. Therefore, the diffused light emitted from the light-emitting element is focused on discrete micro spots to form a latent image on an image bearing member.

In the optical print head, an imaging element array such as a rod lens array or roof prism lens array is provided to form good optical spots. Therefore, the relative positions of the light-emitting element and the imaging element and the imaging element and the image bearing member are adjusted with a high degree of precision. That is, the focal depth of the imaging element is several tens of μm, which is extremely small in comparison with that of a lens for use in a typical scanning optical system. In addition, the numerical aperture of the lens is small. Therefore, the lens and the imaging element are adjusted to keep their relative positions to be of a high degree of precision.

As a technique to adjust the relative positions of an imaging element and an image bearing member to a high degree of precision, for example, Japanese patent application publication no. H06-8516 (JP-H06-8516-A) describes an LED array head 83 having an adjustment device to move the center of the conjugation length of a rod lens array 85 between the light-emitting plane of a light-emitting element and the surface of a photoreceptor drum 81 irradiated with light by changing the position of a holder 84 of the LED array head 83 against a supporting member 82 that supports the photoreceptor drum 81, as shown in FIG. 8.

Furthermore, as illustrated in FIGS. 9A and 9B, an optical print head 91 is known that adjusts focus and prevents displacement of the optical print head 91 by three eccentric cams provided at the front and rear of the optical print head in the longitudinal direction thereof.

However, as image forming apparatuses continues to become more compact, increasingly narrower optical print heads are demanded. Such a narrow optical print head paired with a narrow supporting member leads to a problem that the optical print head is easily displaced.

Once the optical print head is displaced, the writing position is also displaced from the proper position and beam profiles deteriorate due to being out of focus, which causes degradation of image quality.

Moreover, in color image forming apparatuses, the tilt of each color optical print head in the sub-scanning direction is adjusted with a high degree of precision to prevent occurrence of color misalignment. Similarly, the position in the main scanning direction must be adjusted.

SUMMARY OF THE INVENTION

In view of the foregoing, the present invention provides an improved image forming apparatus having an image bearing member, an optical print head to irradiate the image bearing member with light to form a latent image thereon; a developing device to develop the latent image with a developing agent to obtain a visual image, and front and rear plates that sandwich at least the image bearing member and the developing device from opposite directions to position at least the image bearing member and the developing device, the plates having focus direction position determining reference surfaces and sub-scanning direction position determining reference surfaces that the optical print head contacts to position the optical print head.

It is preferable that the image forming apparatus mentioned above further includes biasing devices to bias the optical print head to the focus direction position determining reference surfaces and the sub-scanning direction position determining reference surfaces.

It is still further preferable that, in the image forming apparatus mentioned above, the biasing devices includes a coil spring fixed on a stay of the image forming apparatus to bias the optical print head against the focus direction position determining reference surfaces and a board spring fixed on the stay to bias the optical print head against sub-scanning direction position determining reference surfaces.

It is still further preferable that, in the image forming apparatus mentioned above, the plates further includes a main scanning direction position determining device to position the optical print head in the main scanning direction.

It is still further preferable that, in the image forming apparatus mentioned above, the main scanning direction positioning device includes a pin provided to the rear plate.

As another aspect of the present invention, an optical print head is provided that includes a focus adjustment device to change the position of the optical print head to focus direction position determining reference surfaces of front and rear plates that sandwich at least an image bearing member and a developing device from opposite directions to position at least the image bearing member and the developing device, the plates bearing both ends of the optical print head in the longitudinal direction.

It is preferable that, in the image forming apparatus mentioned above, the focus adjustment device includes a focus adjustment screw provided on the bottom surface of one side of the optical print head.

It is still further preferable that the optical print head mentioned above further includes a sub-scanning direction adjustment device to change the position of the optical print head relative to the sub-scanning direction position determining reference surfaces of the plates, the sub-scanning direction adjustment device being provided at one side of the optical print head in the longitudinal direction.

It is still further preferable that the optical print head mentioned above further includes a sub-scanning direction reference portion provided at the opposing end of the sub-scanning direction adjustment device and contacting the sub-scanning direction position determining reference surfaces of the plates at two or more points or with a surface.

It is still further preferable that the optical print head mentioned above further includes a main scanning direction position determining device provided at one end of the optical print head in the longitudinal direction to position the optical print head in the main scanning direction.

As another aspect of the present invention, an image forming apparatus is provided that includes an image bearing member, the optical print head mentioned above to irradiate the image bearing member to form a latent image thereon, and a developing device to develop the latent image with a developing agent to obtain a visual image.

As another aspect of the present invention, a process cartridge is provided that includes an image bearing member and the optical print head mentioned above to irradiate the image bearing member to form a latent image thereon.

As another aspect of the present invention, an image forming apparatus is provided that includes the process cartridge mentioned above.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PRESENT INVENTION

The structure related to the present disclosure is described in detail based on embodiments with reference to the accompanied drawings, in particular FIGS. 1 to 7B.

Image Forming Apparatus

Figure 1:
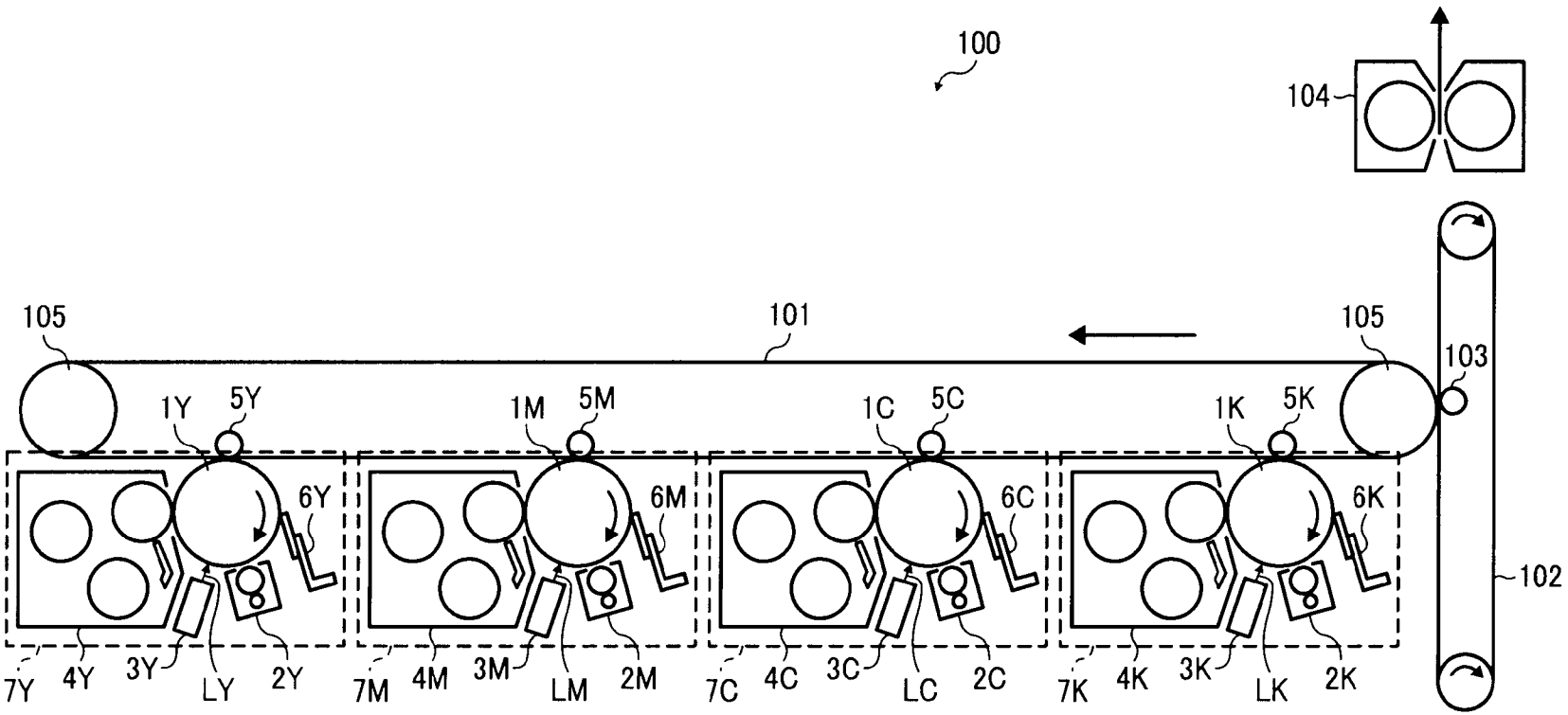
FIG. 1 is a schematic diagram illustrating an example of the image forming apparatus related to the present disclosure.

FIG. 1 is a schematic diagram illustrating the structure of the main portion of a color image forming apparatus 100, which is an embodiment of an image forming apparatus having the optical print head related to the present disclosure. The symbols of Y, M, C, and K represent portions corresponding to colors of yellow, magenta, cyan, and black, respectively.

The image forming apparatus 100 related to the present disclosure is a tandem type color image forming apparatus in which multiple image bearing members 1Y, 1M, 1C, and 1K are sequentially arranged. The image bearing members 1Y, 1M, 1C, and 1K corresponding to each color are provided with an equal gap therebetween facing an intermediate transfer belt 101. The image bearing members 1Y, 1M, 1C, and 1K have the same diameter and respective members are provided around the image bearing members 1Y, 1M, 1C, and 1K according to the electrophotographic processes.

The image bearing member 1Y is taken as an example for description. Around the image bearing member 1Y are sequentially provided a charger 2Y, an optical print head 3Y to emit emission light LY according to image data as an irradiation device, a developing device 4Y, a transfer roller 5Y, and a cleaner 6Y. 7Y, 7M, 7C, and 7K represent integrated process cartridges including the image bearing members for each color and therearound.

The same applies to the other image bearing members 1M, 1C, and 1K. That is, in this embodiment, the image bearing members 1Y, 1M, 1C, and 1K are surfaces irradiated with light for each color. The optical print heads 3Y, 3M, 3C, and 3*k* irradiate those image bearing members with the emission light LY, LM, LC, and LK, respectively.

The surface of the image bearing member 1Y is uniformly charged by the charger 2Y. The emission light LY scans the surface while the image bearing member 1Y rotates to form a latent electrostatic image on the image bearing member 1Y. In the embodiment illustrated in FIG. 1, the charger 2Y is a charging roller but not limited thereto.

On the downstream side of the irradiation position of the emission light LY emitted from the optical print head 3Y relative to the rotation direction of the image bearing member 1Y, the charger 4Y is provided to supply yellow toner to the image bearing member 1Y.

The toner supplied from the developing device 4Y is attached to the portion where the latent electrostatic image is formed to form a toner image. Similarly, single color images of magenta, cyan, and black are formed on the image bearing members 1M, 1C, and 1K.

The intermediate transfer belt 101 is provided on the downstream side of the provision position of the developing devices 4 of the image bearing members 1 relative to the rotation direction thereof. The intermediate transfer belt 101 is wound round a transfer roller 105 provided on both ends of the intermediate transfer belt 101 and transferred by a motor in the direction indicated by an arrow.

The transfer rollers 5Y, 5M, 5C, and 5K sequentially overlap respective single color toner images developed by the image bearing members 1 and transfer the overlapped image to the intermediate transfer belt 101 to form a color image thereon.

Furthermore, a bias is applied to a secondary transfer roller 103, where the four color toner image transferred by the transfer belt 102 is transferred at once to a recording medium (typically paper). The recording medium on which the color toner image is formed is fixed by a fixing device 104 and thereafter discharged out of the image forming apparatus 100.

Optical Print Head

Figure 2:
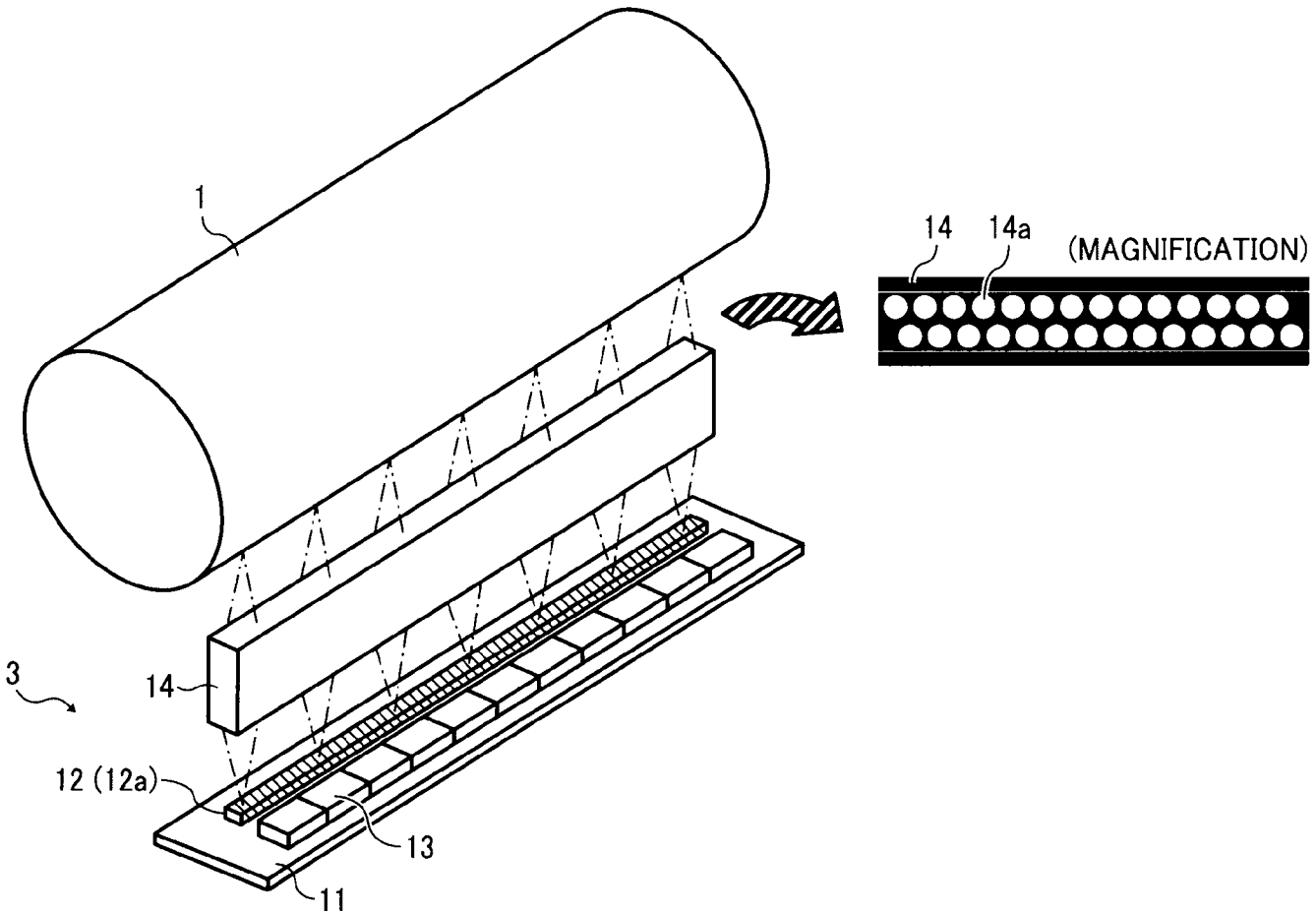
FIG. 2 is a diagram illustrating an optical print head and an image bearing member.

FIG. 2 is a schematic diagram illustrating the optical print head 3 and the image bearing member 1 related to the embodiment. A substrate 11 of the optical print head 3 has multiple LED elements 12*a* serving as light sources set in line. The LED elements 12*a* are installed as LED array chips 12 along the longitudinal direction of the image bearing member 1. In addition, multiple driving ICs 13 are installed to drive the LED elements 12*a*. A single of the driving IC can cover all of the LEDs. Alternatively, the driving IC can be provided as a separate substrate.

On the substrate 11, about several tens to hundreds of LED array chips 12 are installed corresponding to the writing width. In addition, about several tens to hundreds of the LED elements 12*a* are arranged inside each LED array chip 12 and adjacent LED array chips 12 are installed such that the adjacent gap of the LED element 12*a* placed at the ends is a predetermined gap.

For example, in the case of 600 dpi and A4 width (i.e., 210 mm), the required number of the LED elements 12*a* is 4,960 in total for a gap of 42.3 μm and 50 LED array chips 12 are installed when a single LED array chip 12 is formed of 100 LED elements 12*a*. Similarly, in the case of 1,200 dpi and A3 width (i.e., 297 mm), the required number of the LED elements 12*a* is about 14,000 in total and 140 LED array chips 12 are installed when a single LED array chip 12 is formed of 100 LED elements 12*a*.

Since the LED element 12*a* is to emit diffused light from a particular point or plane, the diffused light emitted from the LED elements 12*a* must be focused on micro spots to form a latent image on the surface of an image bearing member. Therefore, as the imaging optical element, for example, it is suitable to use a micro lens array or a gradient index type rod lens array.

In this embodiment, a rod lens array 14 bundling rod lenses 14*a* having a gradient index is used to focus diffused light onto the surface of the image bearing member. As illustrated in the enlarged diagram in FIG. 2, in the rod lens array 14, the gradient index type rod lens array 14*a* having a cylinder form with a gradient index having a quadratic curve distribution in the radius direction are arranged in two lines in a zigzag way. In addition, an opaque resin (black resin) is filled and cured in the gap between respective rod lenses 14*a* to reduce flare light escaping from the gap between the rod lenses 14*a*. Moreover, the rod lenses 14*a* are held from both sides by a resin member in which glass having a linear expansion coefficient significantly equal to that of the rod lenses 14*a*.

Attachment of Optical Print Head

Figure 3:
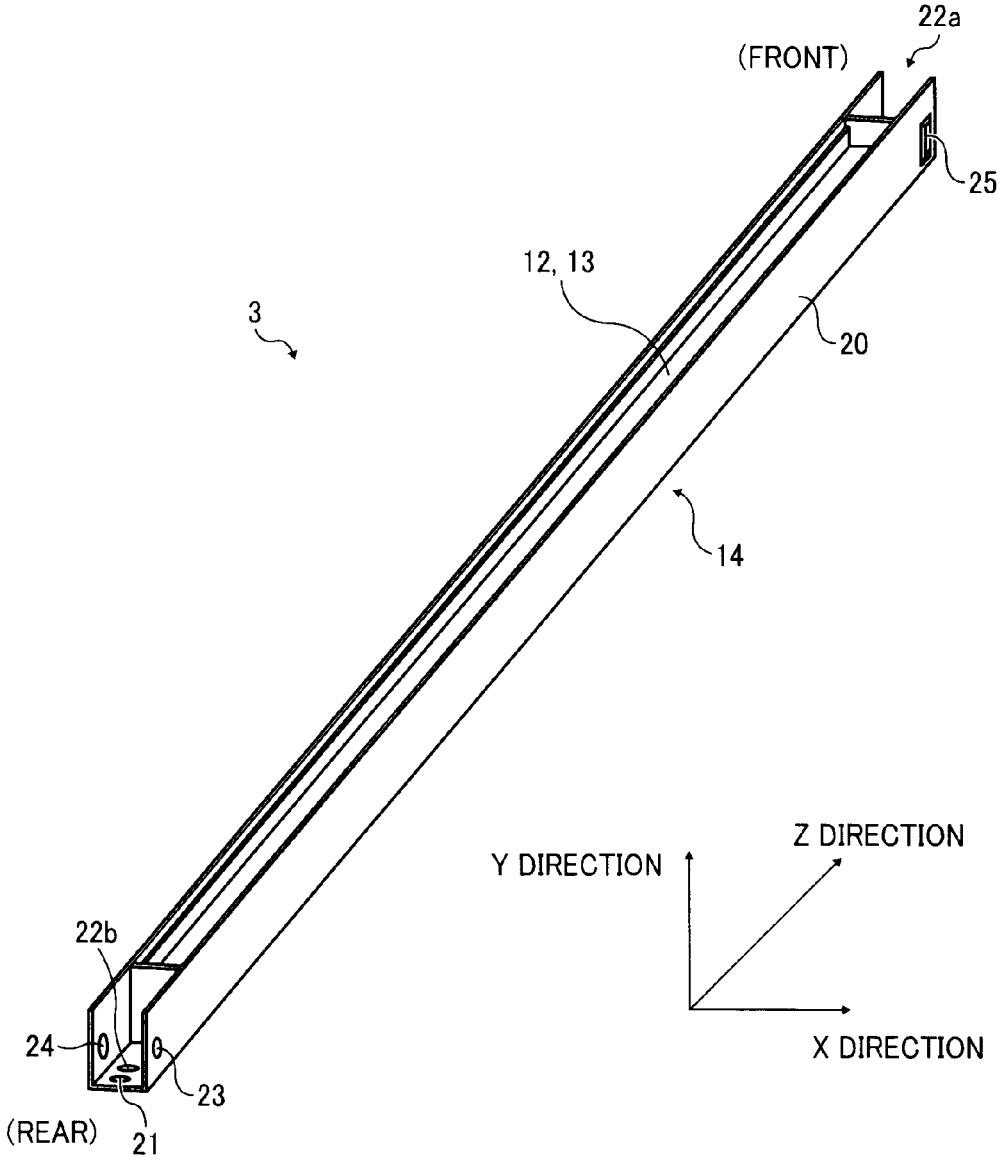
FIG. 3 is a perspective view of the optical print head.
Figure 4B:
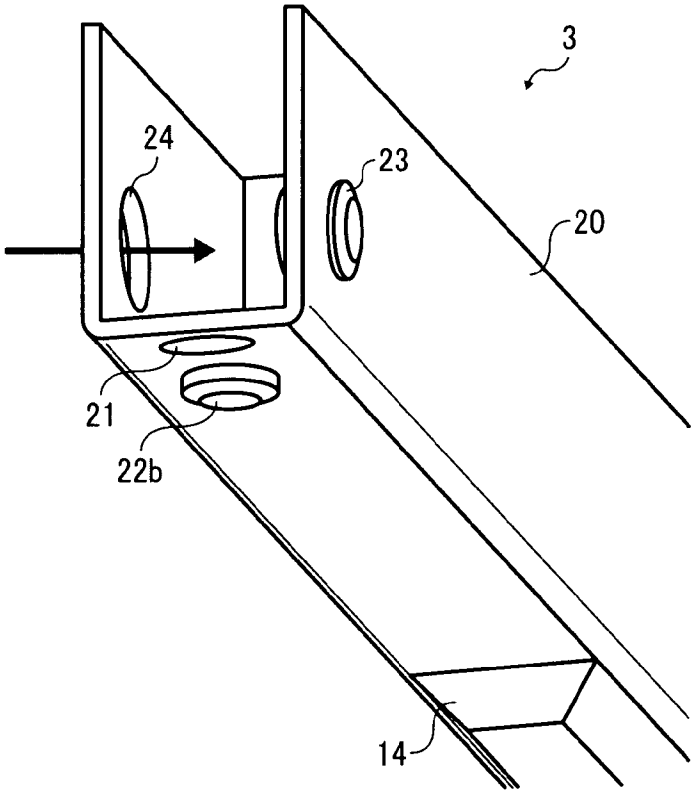
FIG. 4A is a top perspective view of the optical print head from the rear end side and FIG. 4B is a bottom perspective view of the optical print head from the rear end side.
Figure 4A:
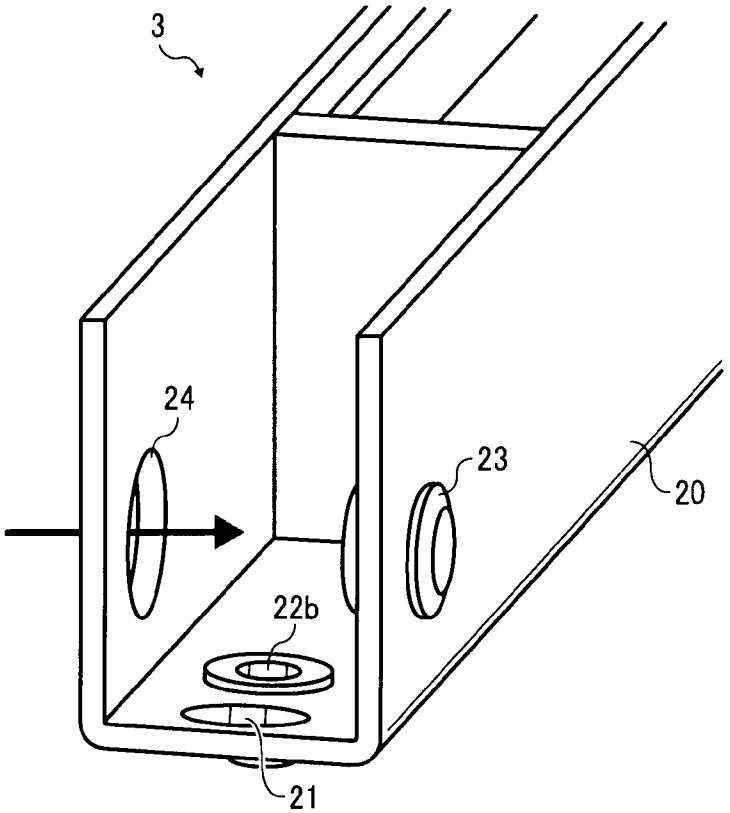

The attachment mechanism of the optical print head 3 to the image forming apparatus 100 is described with reference to FIGS. 3 to 7. FIG. 3 is a perspective view of the optical print head 3, FIG. 4A is a top perspective view on the rear end side of the optical print head 3, FIG. 4B is a bottom perspective view on the rear end side, FIG. 5A is a top perspective view on the front end side of the optical print head 3, and FIG. 5A is a bottom perspective view on the front end side of the optical print head 3. As illustrated in FIG. 3, the length in the longitudinal direction of the optical print head 3 is the main scanning direction (Z direction in FIG. 3), the length in the latitudinal direction of the optical print head 3 is the sub-scanning direction (X direction in FIG. 3), and the emission direction of the laser beam is the focus direction (−Y direction in FIG. 3).

As illustrated in FIG. 3, a lens array 14 is fixed on the bottom surface of a main frame 20 of the optical print head 3 in which the LED array chips 12 and the driving IC 13 are built in. The main frame 20 is formed of a member having a sufficient rigidity, for example, metal.

A illustrated in FIGS. 4A and 4B, there are provided a position determining hole in the main scanning direction (main scanning direction position determining device) 21 and a focus adjustment screw (focus adjustment device) 22*b* on the bottom surface of the main frame 20 on the end on the rear side of the print head 3 in the longitudinal direction thereof. In addition, there are provided a sub-scanning direction adjustment screw (sub-scanning direction adjustment device) 23 on the side of the main frame 20 and a screw hole 24 for driving an adjustment screw in the sub-scanning direction on the surface of the main frame 20 facing the sub-scanning direction adjustment screw 23.

Figure 5B:
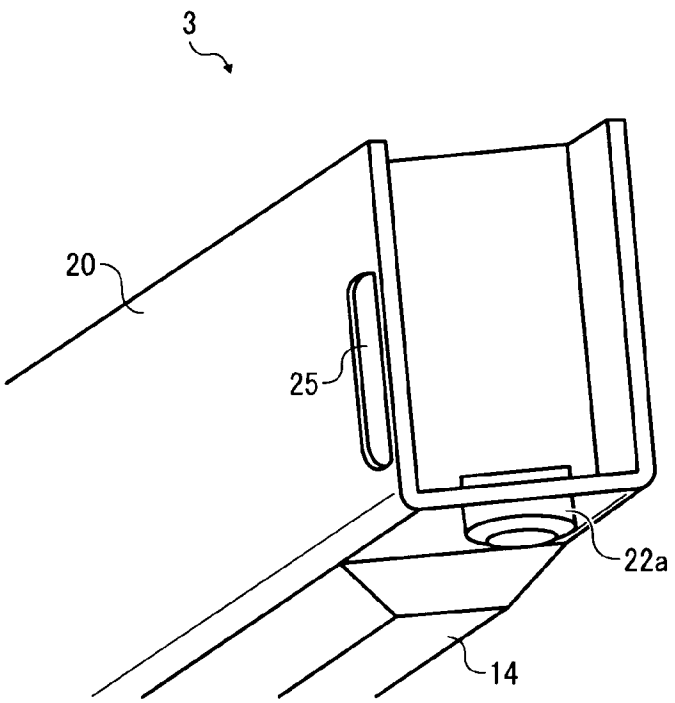
FIG. 5A is a top perspective view of the optical print head from the top end side and FIG. 5B is a bottom perspective view of the optical print head from the top end side.
Figure 5A:
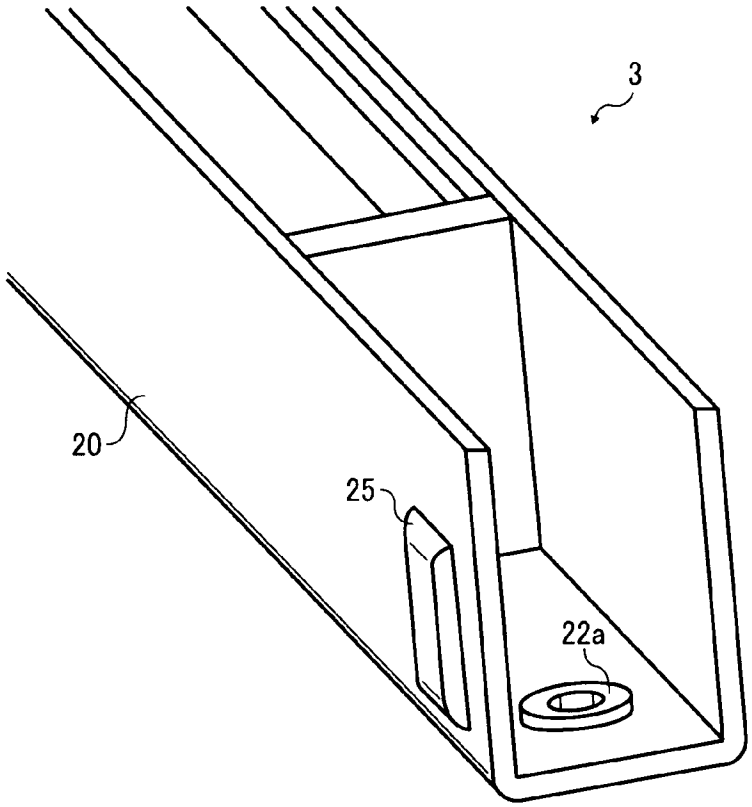

Furthermore, as illustrated in FIGS. 5A and 5B, a focus adjustment screw (focus adjustment device) 22*a* is provided on the bottom surface of the main frame 20 on the end on the front side of the print head 3 in the longitudinal direction thereof. Furthermore, a sub-scanning direction reference surface (sub-scanning direction reference portion) 25 is provided on the side of the frame 20.

The position of the optical print head 3 having such a structure can be determined in the main scanning direction and the sub-scanning direction by the main scanning direction position determining hole 21 and the sub-scanning direction adjustment screw 23, respectively, and the focus can be adjusted by the focus adjustment screws 22*a* and 22*b*.

To be specific, the front ends (on the bottom side) of the focus adjustment screws 22*a* and 22*b* are pressed against focus direction position determining reference surfaces 32*a* and 32*b* of a plate 30 (front plate 30*a* and rear plate 30*b*) described later on the side of the image forming apparatus 100. Therefore, by adjusting the focus adjustment screws 22*a* and 22*b* situated on the front and rear sides, respectively, the focus can be adjusted over the whole range in the main scanning direction. The focus can be adjusted while actually outputting images or observing an image in the air on a reference jig. In addition, it is preferable that the focus adjustment screws 22*a* and 22*b* be fixed by a screw lock, etc. to prevent displacement after focusing adjustment.

By providing the focus adjustment device around both ends of the optical print head 3 in the longitudinal direction thereof, if the focusing position is slanted in the main scanning direction, it is possible to adjust the focal point over the whole range in the main scanning direction. Therefore, the focal point is kept correct in the whole range so that the quality of image is suitably maintained.

The sub-scanning direction adjustment screw 23 is pressed against the sub-scanning direction position determining reference surface 33*b* of the rear plate 30*b* described later. The sub-scanning direction adjustment screw 23 can be rotated by a driver, etc. via the screw hole 24 so that the screw can be tightened or loosened. In addition, the sub-scanning direction reference surface 25 is pressed against the sub-scanning direction position determining reference surface 33*a* of the front plate 30*a* described later. It is suitable to use the sub-scanning direction reference surface 25 that is in contact with the sub-scanning direction position determining reference surface 33*a* with at least two points or a surface.

Therefore, by adjusting the sub-scanning direction adjustment screw 23, the scanning tilt in the main driving direction can be changed with the sub-scanning direction reference surface 25 of the optical print head 3 as the fulcrum.

As described above, by the sub-scanning direction adjustment device provided at least one end of the optical print head 3 in the longitudinal direction thereof, the tilt in the sub-scanning direction can be adjusted. Therefore, in a color image forming apparatus, the image quality can be suitably maintained without color displacement.

Furthermore, by setting the vicinity around the opposite end in the longitudinal direction of the sub-scanning direction adjustment device as the fixing reference (sub-scanning direction reference portion) for receiving a surface or at least two points, if the sub-scanning direction adjustment device is a point adjustment, it is possible to prevent displacement of the optical print head 3 by setting the opposite end as the surface or two-point receiving. Therefore, since the optical print head 3 is free from displacing, deterioration of the beam profile caused by the focus displacement does not occur, thereby maintaining the image quality good.

Since the focus should be adjusted in both front and rear directions to keep the optimal position, the focus adjustment screw 22 must be provided at both ends of the optical print head 3 in the longitudinal direction thereof. On the other hand, slight displacement of the absolute position in the sub-scanning direction can be corrected by the writing timing. If the tilts of the lines for respective colors match, the color displacement does not occur. That is, since one end is set as the reference surface and the tilt can be adjusted at the other end, it is sufficient to provide just a single of the sub-scanning direction adjustment screw 23 as illustrated in FIGS. 3 to 5. Providing the sub-scanning direction adjustment screw 23 at both ends is also suitable.

In addition, the main scanning direction position determining hole 21 is fitted with a main scanning direction position determining pin 31 of the rear plate 30*b* so that the position in the main scanning direction of the optical print head 3 is determined. As described above, by providing the main scanning direction positioning determination device only at a portion in the vicinity of one end in the main scanning direction, the position in the main scanning direction is determined and also the deformation due to linear expansion can be prevented. Therefore, displacement in the main scanning direction caused by line expansion or scanning curve caused by line expansion do not occur, thereby maintaining good image quality.

Figure 6B:
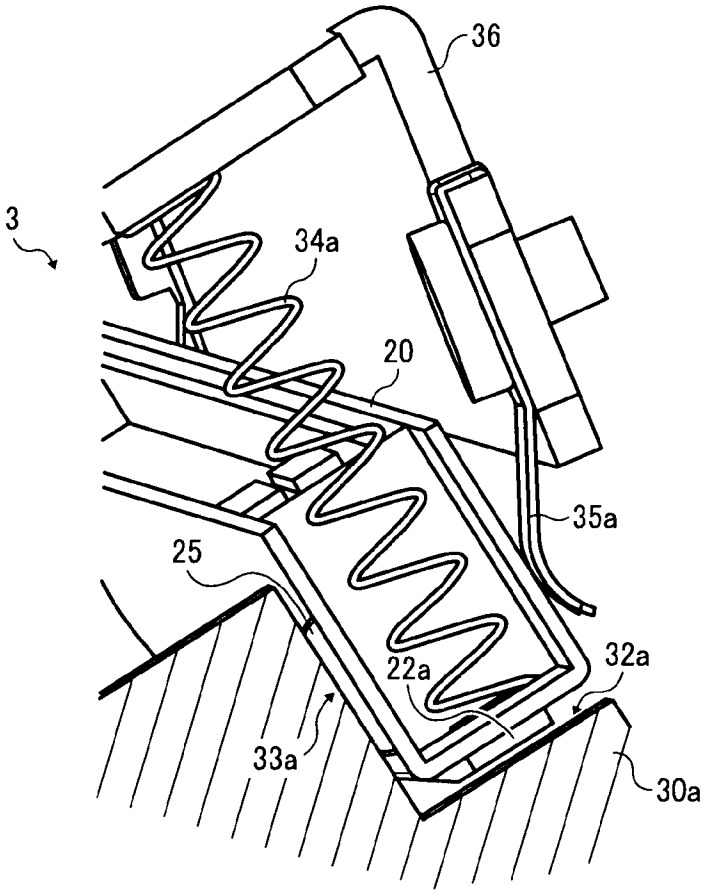
FIG. 6A is a perspective view of the optical print head that is attached to a rear plate in an image forming apparatus and FIG. 6B is a perspective view of the optical print head that is attached to a front plate in the image forming apparatus.
Figure 6A:
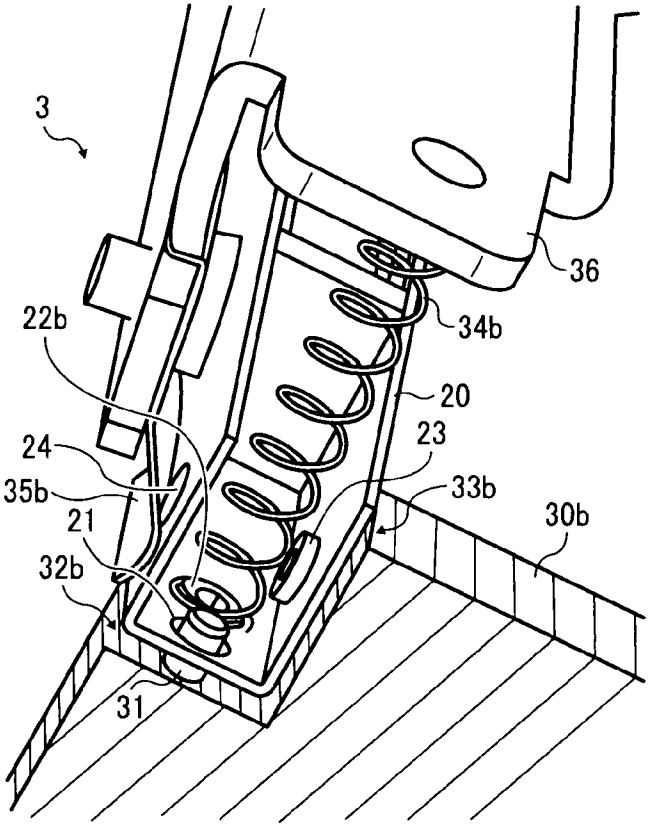
Figure 7B:
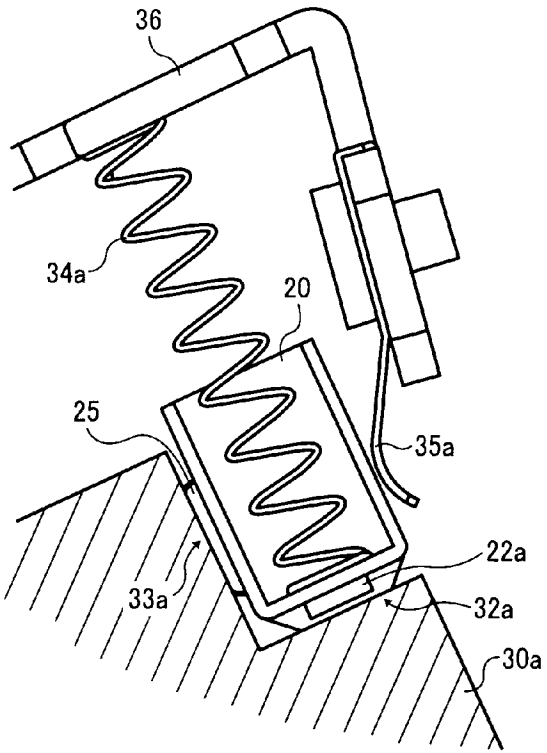
FIG. 7A is a front view of an image forming apparatus in which the optical print head is attached to the plate and FIG. 7B is an enlarged view of adjacent portions of the optical print head.
Figure 7A:
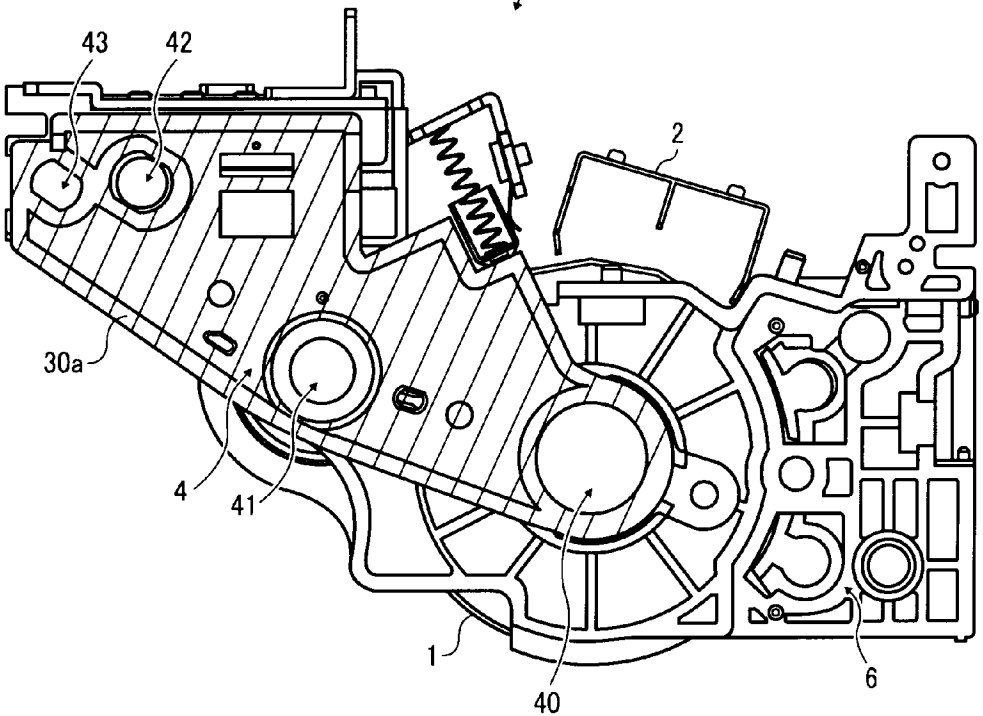
Figure 8:
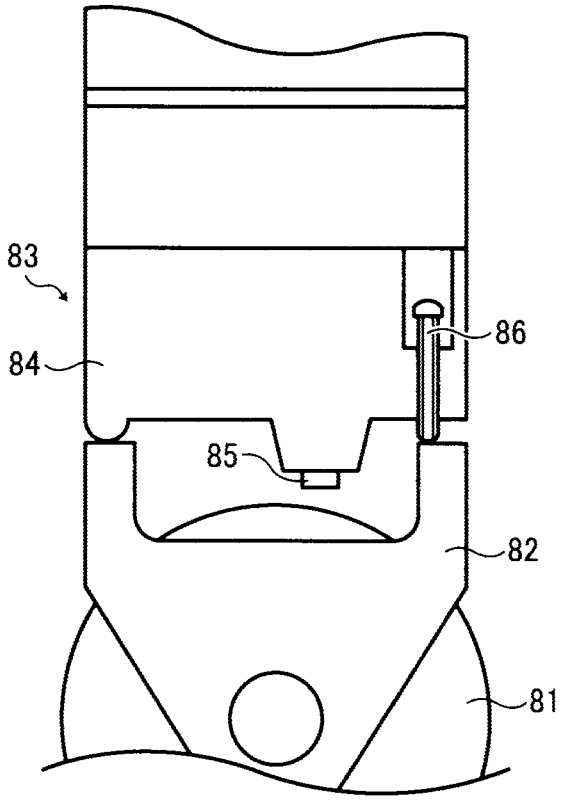
FIG. 8 BACKGROUND ART
FIG. 8 is a diagram illustrating an example of the structure of a typical optical print head.
Figure 9A:
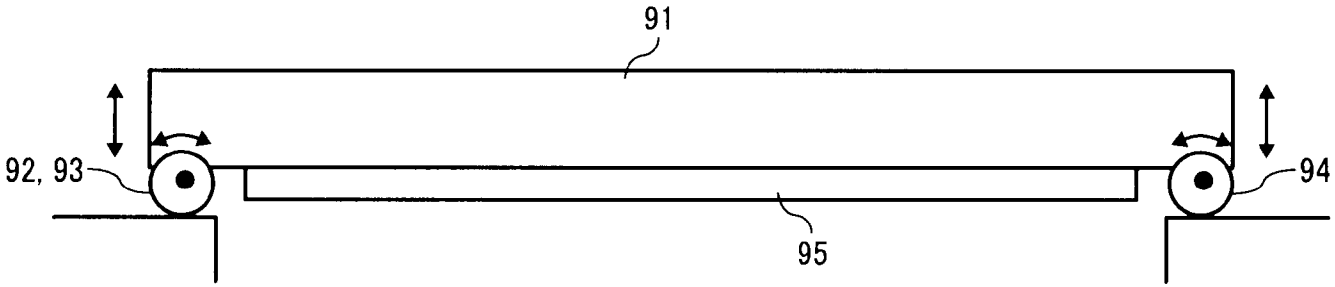
FIG. 9A BACKGROUND ART
FIGS. 9A and 9B are diagrams illustrating an example of the structure of another typical optical print head.
Figure 9B:
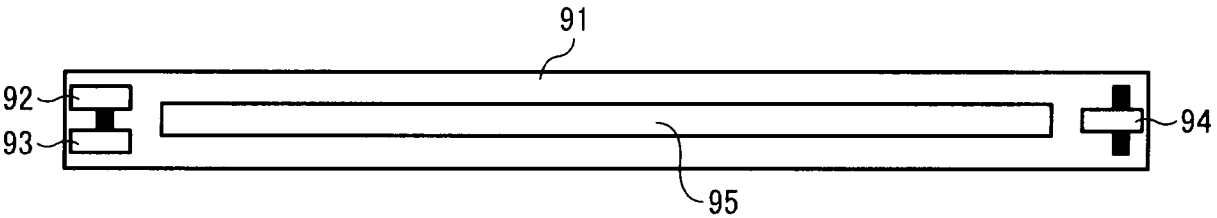
FIG. 9B BACKGROUND ART

Attachment of the image forming apparatus 100 of the optical print head 3 illustrated in FIGS. 3 to 5 are described with reference to FIGS. 6 and 7. FIGS. 6A and 6B are schematic diagrams illustrating the state in which the optical print head 3 is attached to the plate 30 of the image forming apparatus 100. FIG. 6A is a diagram illustrating a perspective view from the side of the rear plate 30*b* and FIG. 6B is a diagram illustrating a perspective view from the side of the front plate 30*a*. In addition, FIG. 7A is a front view of the image forming apparatus 100 (the process cartridge 7) in which the optical print head 3 is attached to the plate 30 and FIG. 7*b* is an enlarged diagram of part of FIG. 7A illustrating the optical print head 3.

Plates 30*a* and 30*b* are, for example, planar members provided, for example, in front of and at the back of the image bearing member 1 and the developing device 4 in the image forming apparatus 100. The plate 30*a* is illustrated in FIG. 7. The plates 30*a* and 30*b* determine the positions of a rotation center axis 40 of the image bearing member 1, a rotation center axis 41 of the development roller, a main reference pin 42, and a development sub-reference pin 43. Therefore, even the optical print head 3 having a narrow width is accurately positioned and adjusted to the image bearing member 1 without displacing by providing the reference surfaces in the focus direction (focus direction position determining reference surfaces 32*a* and 32*b*) and the sub-scanning direction (sub-scanning direction position determining reference surfaces 33*a* and 33*b*) at which the optical print head 3 contacts the plates 30*a* and 30*b*. Therefore, the image quality can be maintained good without degrading the beam profile caused by misplacement of the writing position and being out of focus while preventing displacement of the optical print head 3.

As illustrated in FIG. 6A, a main scanning direction positioning pin (main scanning direction position determination device) 31 provided to the rear plate 30*b* of in the image forming apparatus 100 are fitted in with the main scanning direction position determining hole 21 of the optical print head 3, thereby determining the position of the optical print head 3 in the main scanning direction. The optical print head 3 is fitted in the main scanning direction on one side. In this embodiment, only the rear end is fitted. This is because the optical print head 3 having both sides fitted in the main scanning direction may not be able to freely expand when the temperature changes, resulting in deformation of the optical print head 3.

By providing the position determining device in the main scanning direction of the optical print head 3 to the rear plate 30*b*, the position of the optical print head 3 can be determined in the main scanning direction by the combination of the position determination device on the side of the optical print head 3 with the position determining device in the main scanning direction thereof. Therefore, displacement in the main scanning direction caused by line expansion or scanning curve caused by line expansion do not occur, thereby maintaining good image quality.

In addition, the rear plate 30*b* has the focus direction position determining reference surface 32*b* in the focus direction and the sub-scanning direction position determining reference surface 33*b* in the sub-scanning direction. The focus adjustment screw 22*b* of the optical print head 3 is in contact with the focus direction position determining reference surface 32*b* and the sub-scanning direction adjustment screw 23 of the optical print head 3 is in contact with the sub-scanning direction position determining reference surface 33*b*.

Furthermore, the optical print head 3 is biased to the focus direction position determining reference surface 32*b* of the rear plate 30*b* by a focus direction pressure spring 34*b*, which is a coil spring fixed on a stay 36 of the image forming apparatus 100. Similarly, the optical print head 3 is biased to the sub-scanning direction position determining reference surface 33*b* of the plate 30*b* by the sub-scanning direction pressure spring 35*b*, which is a board spring fixed on the stay 36. By such a structure, the position of the optical print head 3 can be finely adjusted by rotating the focus adjustment screw 22*b* and the sub-scanning direction adjustment screw 23. It is to be noted that although a coil spring and a board spring are used in this embodiment the biasing device is not limited thereto.

As illustrated in FIG. 6B, similar to the rear side, the front side of the optical print head 3 is biased to the focus direction position determining reference surface 32*a* and the sub-scanning direction position determining reference surface 33*a* of the front plate 30*a* by springs (focus direction pressure spring 34*a* and sub-scanning direction pressure spring 35*a*) fixed on the stay 36 of the image forming apparatus 100.

As described above, since the optical print head 3 can be tightly in contact with the respective position determining reference surfaces 32 and 33 by a biasing device such as a spring, the optical print head 3 is prevented from displacing and free from displacement of the writing position and degradation of the beam profiles, thereby maintaining the image quality good.

By using the optical print head 3 described above and the image forming apparatus 100 having the optical print head 3, if the optical print head 3 has a narrow width, the optical print head 3 can be prevented from displacing at the lateral sides and adjust the focus on the bottom side. In addition, since the receiving at the lateral sides can be adjusted, the tilting of the line in the sub-scanning direction can be adjusted. Furthermore, the process cartridge 7 having the optical print head 3 having the structure described above has the same effect.

Having now fully described the invention, it will be apparent to one of skill in the art that many changes and modifications can be made thereto without departing from the scope of the invention as set forth therein.

What is claimed is:

1. An image forming apparatus comprising:

an image bearing member;

an optical print head that extends in a longitudinal direction along the image bearing member to irradiate the image bearing member with light to form a latent image thereon;

a frame on which the optical print head is fixed, the frame extending in the longitudinal direction of the optical print head and extending on each end thereof beyond corresponding ends of the optical print head, and each end of the frame including a first wall that adjoins a second wall that is transverse to the first wall, the first wall extending along a same place of longitudinal extension as the optical print head, and the second wall extending longitudinally along an entirety of a lateral side length of the optical print head;

a developing device to develop the latent image with a developing agent to obtain a visual image; and front and rear plates that sandwich at least the image bearing member and the developing device from opposite directions to position at least the image bearing member and the developing device, the plates having focus direction position determining reference surfaces and sub-scanning direction position determining reference surfaces that support the optical print head via the first and second walls of the frame, respectively, to position the optical print head, the focus direction position determining reference surfaces and the sub-scanning direction position determining reference surfaces of the front and rear plates, respectively, being located along an edge of a perimeter of the front and rear plates respectively, wherein a first end of the second wall of the frame in a longitudinal direction has a sub-scanning direction reference surface that abuts the sub-scanning direction position determining reference surface of the front plate, and a second end of the second wall of the frame which is opposite the first end has a sub-scanning direction adjustment member that abuts the sub-scanning direction position determining reference surface of the rear plate.

2. The image forming apparatus according to claim 1, further comprising biasing devices to bias the optical print head to the focus direction position determining reference surfaces and the sub-scanning direction position determining reference surfaces.

3. The image forming apparatus according to claim 2, wherein the biasing devices comprise a coil spring fixed on a stay of the image forming apparatus to bias the optical print head against the focus direction position determining reference surfaces and a board spring fixed on the stay to bias the optical print head against sub-scanning direction position determining reference surfaces.

4. The image forming apparatus according to claim 1, wherein the plates further comprise a main scanning direction position determining device to position the optical print head in a main scanning direction.

5. The image forming apparatus according to claim 4, wherein the main scanning direction positioning device comprises a pin provided to the rear plate.

6. An apparatus comprising:

an optical print head that extends in a longitudinal direction along an image bearing member to irradiate the image bearing member with light to form a latent image thereon;

a frame on which the optical print head is fixed, the frame extending in a longitudinal direction of the optical print head and extending on each end thereof beyond corresponding ends of the optical print head, and each end of the frame including a first wall that adjoins a second wall that is transverse to the first wall, the first wall extending along a same place of longitudinal extension as the optical print head, and the second wall extending longitudinally along an entirety of a lateral side length of the optical print head; and a focus adjustment device to change a position of the optical print head with respect to focus direction position determining reference surfaces of front and rear plates, respectively, that sandwich at least the image bearing member and a developing device from opposite directions to position at least the image bearing member and the developing device, the plates bearing both ends of the frame in the longitudinal direction, and the plates having the focus direction position determining reference surfaces and sub-scanning direction position determining reference surfaces that support the optical print head via the first and second walls of the frame, respectively, to position the optical print head, the focus direction position determining reference surfaces and the sub-scanning direction position determining reference surfaces of the front and rear plates, respectively, being located along an edge of a perimeter of the front and rear plates respectively, wherein a first end of the second wall of the frame in a longitudinal direction has a sub-scanning direction reference surface that abuts the sub-scanning direction position determining reference surface of the front plate, and a second end of the second wall of the frame which is opposite the first end has a sub-scanning direction adjustment member that abuts the sub-scanning direction position determining reference surface of the rear plate.

7. The apparatus according to claim 6, wherein the focus adjustment device comprises a focus adjustment screw provided on the first wall of the frame, which is a bottom surface of the frame on one side of the optical print head.

8. The apparatus according to claim 6, further comprising a main scanning direction position determining device provided at one end of the optical print head in the longitudinal direction to position the optical print head in a main scanning direction.

9. An image forming apparatus comprising:

an image bearing member;

the apparatus of claim 6 to irradiate the image bearing member to form a latent image thereon; and a developing device to develop the latent image with a developing agent to obtain a visual image.

10. A process cartridge comprising:

an image bearing member; and the apparatus of claim 6 to irradiate the image bearing member to form a latent image thereon.

11. An image forming apparatus comprising:

the process cartridge of claim 10.

12. The image forming apparatus according to claim 5, wherein the pin extends through the focus direction position determining reference surface on one of the ends of the frame.

* * * * *